US006110012A

United States Patent [19]

Maury et al.

[11] Patent Number: 6,110,012

[45] Date of Patent: Aug. 29, 2000

[54] CHEMICAL-MECHANICAL POLISHING APPARATUS AND METHOD

[75] Inventors: Alvaro Maury; Arun Kumar Nanda; Jose Omar Rodriguez, all of Orlando, Fla.

[73] Assignee: Lucent Technologies Inc., Murray Hill, N.J.

[21] Appl. No.: 09/220,417

[22] Filed: Dec. 24, 1998

[51] Int. Cl.[7] ..... B24B 1/00; B24B 29/00

[52] U.S. Cl. ..... 451/36; 451/285; 451/41

[58] Field of Search ..... 451/36, 41, 285, 451/286, 287, 288, 289, 290, 385, 398, 446

[56] References Cited

U.S. PATENT DOCUMENTS 5,584,751 12/1996 Kobayashi et al. .
5,795,215 9/1998 Guthrie et al. .
5,931,725 8/1999 Inaba et al. ..... 451/288

*Primary Examiner*—Rodney Butler

[57] ABSTRACT

A method and apparatus for limiting or eliminating the edge effect in a chemical mechanical polishing apparatus comprising a substrate holder and a retaining ring spaced from and around the holder, a rotatable platen and a polishing pad on the platen, by essentially flattening the pad in the area in which it normally tends to deform. The invention is carried out by applying a fluid under pressure, preferably the polishing slurry, to the pad in the region of the gap between the retaining ring and the holder to substantially flatten the pad in the area around the edge of the substrate.

12 Claims, 2 Drawing Sheets

CHEMICAL-MECHANICAL POLISHING APPARATUS AND METHOD

BACKGROUND OF THE INVENTION

1. Field of the Invention

The present invention relates to chemical-mechanical polishing (CMP) apparatus and methods primarily for use in processing semiconductor substrates.

2. Background of the Art

In certain technologies, such as integrated circuit fabrication, optical device manufacture and the like, it is often crucial that the workpiece from which the device is to be formed have a substantially planar surface.

One process for providing such a planar surface is to scour the surface with a conformal polishing pad having a fine abrasive thereon, commonly called "mechanical polishing". When a chemical etchant is used in combination with the mechanical abrasive material, the combined action is termed chemical mechanical polishing (CMP). The CMP technique is common for the manufacture of semiconductor wafers used for the fabrication of integrated circuit die.

One recurring problem with CMP processing is a tendency to over-polish the edge of the wafer. This problem is due to the normal stress across the wafer surface not being uniform because the polishing pad deforms at the wafer edge under the polishing force. Such "edge effect" can result in reduced yield of devices from the wafer. This edge effect is described more fully in U.S. Pat. Nos. 5,584,751 and 5,795,215, which patents are incorporated herein by reference.

CMP apparatus is in widespread use in the semiconductor manufacturing industry. Characteristic of earlier CMP equipment is the apparatus 10 shown in simplified form by way of FIG. 1. Here, a circular platen 12 with a soft, compliant polishing pad 14 affixed to the top surface of the platen 12 is rotated by means of a motor (not shown). A wafer carrier 16, holding a semiconductor wafer 18 in place juxtaposed against the pad 14. The wafer 18 is typically held in place either by a carrier film (not shown) one side of which is adhered to the bottom of the carrier 16 and the other side of which adheres to the top of the wafer 18 by suction means; a vacuum; or by means of an adhesive or wax placed between the wafer and the carrier 16. A chemical mechanical polishing slurry 20 is introduced onto the central surface area of the rotating pad 14 from a slurry reservoir by means of a slurry delivery tube 22 and is distributed over the pad 14 by centrifugal force. The wafer carrier 16 is also typically rotated about its axis in the same direction as the rotation of the platen 12.

It was found that when using this early design, there was a deformity of the polishing pad which caused a substantially higher rate of polishing around the edge of the wafer and also, sometimes a ring of lesser polishing rate than the center of the wafer adjacent to high polishing rate outer ring. This problem was alleviated in part, by modifying the wafer carrier 16 configuration so as to include a fixed retaining ring 23 and a moveable retainer ring 24. The fixed retainer ring 23 abuts the periphery of the carrier 16 and extends below the top edge of the wafer 18 so as to prevent the wafer 18 from slipping out from under the carrier during polishing. The moveable retaining ring 24 (see FIG. 2) is spaced from the periphery of the carrier 16 and/or fixed retaining ring 23 so as to form a gap 26 between the moveable retaining ring 24 and the outer wall of the wafer holder. The term wafer holder is defined as the carrier alone when no fixed retaining ring is present or the carrier with the fixed retaining ring there-around when one is present. The pressure applied to the moveable retaining ring 24 can be adjusted independently of the pressure applied to the carrier 16. A more detailed description of a retaining ring-carrier assembly taught in the prior art can be found with reference to the two aforementioned issued patents. However, while this design reduced the extent of the edge effect problem, the problem still exists, but to a lesser degree. It has been found that the edge effect is minimized as the width of the gap 26 is reduced. However, the gap cannat be made too narrow since the moveable ring 24 must not rub against the wafer holder to insure against particulate or mechanical binding of the ring 24. Further, widening of the gap 26 allows the polishing pad 14 to deform inside it, again increasing the edge effect.

SUMMARY OF THE INVENTION

The purpose of the present invention is to provide a method and apparatus for further limiting or eliminating the edge effect by essentially flattening the pad in the area in which it normally tends to deform.

The invention is carried out by applying a fluid under pressure, preferably the polishing slurry, to the pad in the region of the gap between the moveable retaining ring and the wafer holder. If the fluid is applied under sufficient pressure, estimated to typically be between about 1 and 10 psi, it will flatten the pad in the area around the edge of the wafer, substantially reducing the edge effect.

The invention may be carried out by way of a CMP apparatus that includes a conduit for providing a flow of slurry under pressure to the gap between the moveable retaining ring and the wafer holder from a source of slurry under pressure. Alternatively, the fluid may simply be a gas stream or a liquid which may or may not contain a chemical and/or polishing agent.

It should be noted that while the invention is described in terms of polishing a semiconductor wafer it applies equally to the polishing of any substrate employing an apparatus of this type and therefore, the term wafer is meant to include any substrate to be polished.

DETAILED DESCRIPTION OF THE INVENTION

In accordance with the present invention, the edge effect caused by uneven polishing pad deformation found in prior art CMP apparatus comprising a rotatable platen having a polishing pad on the top surface thereof, a wafer holder for holding a semiconductor wafer juxtaposed to the polishing pad, a moveable wafer retaining ring around the outer periphery of the wafer holder and spaced therefrom to provide a small gap between the ring and the wafer holder, and a slurry delivery tube for supplying CMP slurry to the surface of the pad, is minimized or eliminated by introducing polishing slurry into the gap between the retaining ring and the wafer holder, under sufficient pressure to provide a substantially flat pad surface around the edge of the wafer during polishing. Since the amount of deformation of the pad will depend upon processing variables such as the speed of rotation of the platen and/or the wafer holder, the temperature, the pressure of the wafer on the surface of the pad and the like, it is preferred that the pressure of the slurry delivered to the gap be able to be adjusted so that one can obtain the best degree of flattening for any particular operating condition. This can be accomplished by any means well known in this and similar arts for delivering fluids under pressure, e.g. a pneumatic delivery system wherein the pressure of the air above the fluid and/or the size of a variable size nozzle determines the pressure under which the fluid is delivered as well as the rate of delivery, or a syringe-like delivery system.

Figure 1:
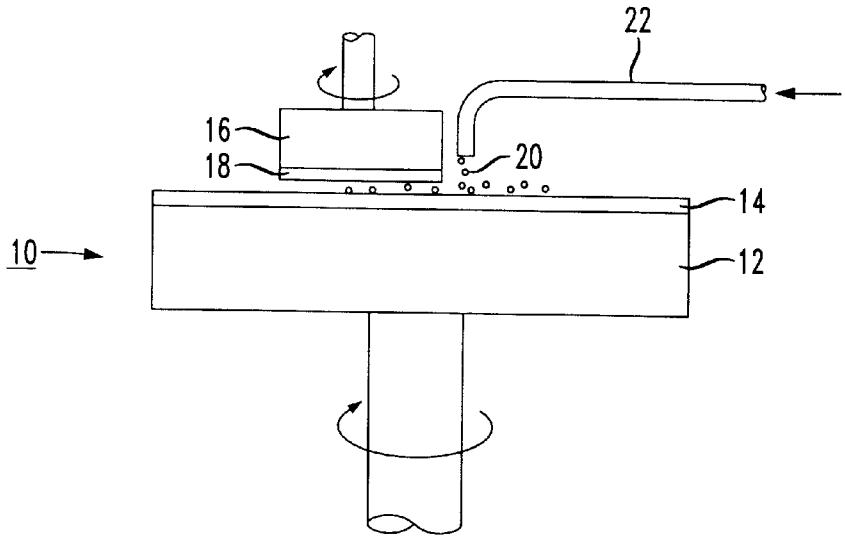
FIG. 1 PRIOR ART
FIG. 1 is a schematic simplified diagram of a prior art CMP apparatus.
Figure 2:
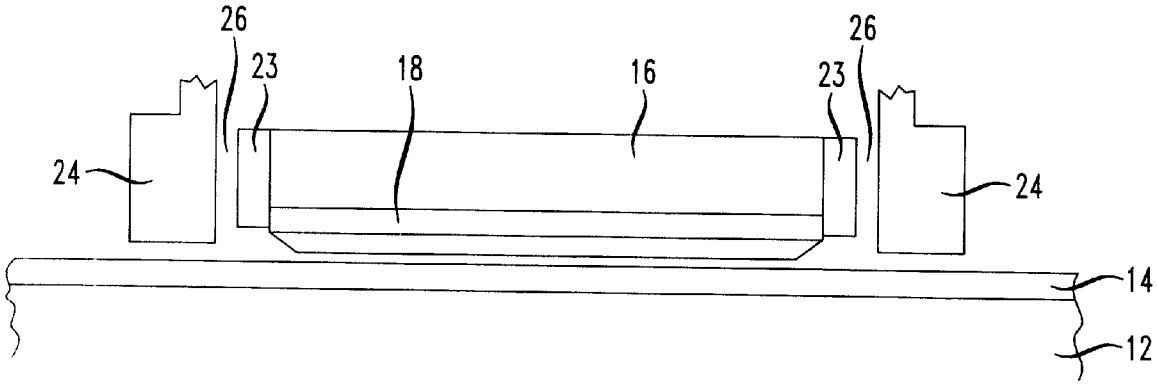
FIG. 2 PRIOR ART
FIG. 2 is a schematic diagram of a prior art, improved wafer carrier of the apparatus shown in FIG. 1 further showing the problem of pad deformation.
Figure 3:
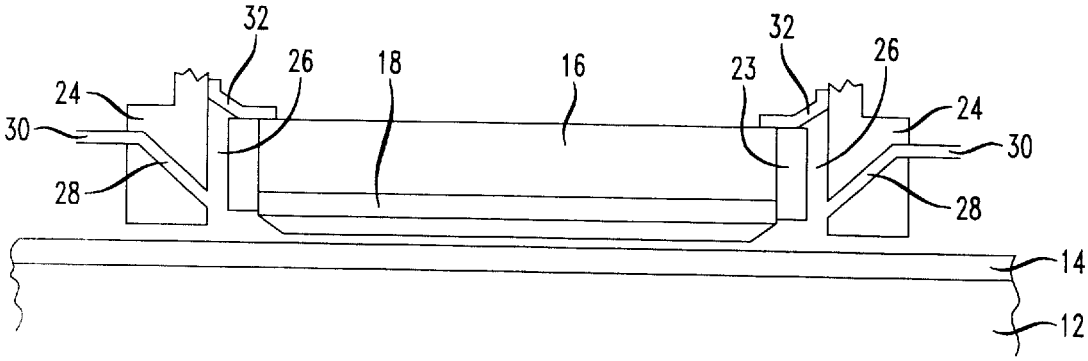
FIG. 3 is a cross sectional view of an embodiment of the invention wherein a slurry conduit is provided in the moveable retaining ring.

Referring to FIG. 3, there is shown a simplified version of one embodiment of the invention wherein the fluid, e.g. CMP slurry, is injected into the gap 26 via one or more fluid delivery passages or conduits 28 through the moveable retainer ring 24 which delivers fluid passing therethrough into the gap 26. The fluid is delivered to the conduit 28 via a fluid supply tube 30 which is connected to the conduit 28. Preferably, the fluid emitted from the conduit 28 into the gap 26 is emitted in a downward direction so as to apply a force against the underlying pad 14. Also, it is preferred to include a flexible gap seal membrane 32 affixed to the wafer holder and moveable retaining ring 24 to prevent the loss of slurry out of the top of the gap while still allowing the pressure applied to the moveable retaining ring 24 to be adjusted independently from the pressure on the carrier 16.

Figure 4:
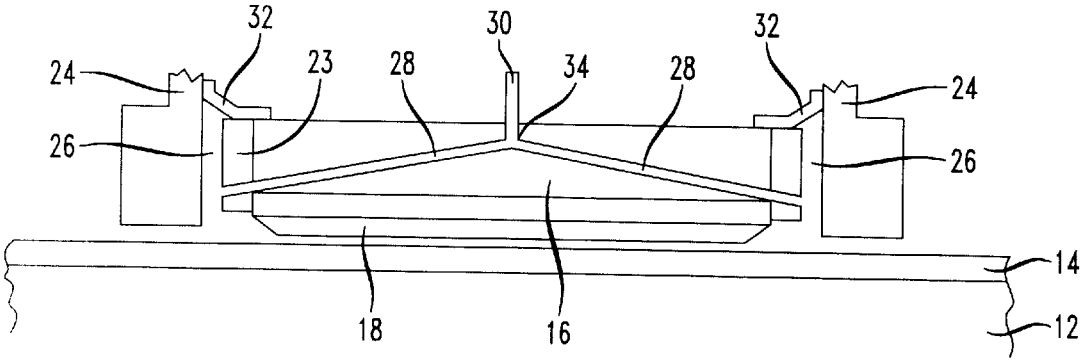
FIG. 4 is a cross sectional view of another embodiment of the invention wherein the slurry conduit is provided in the wafer holder.

An alternative embodiment is shown with reference to FIG. 4 wherein the conduits 28 are provided in and through the wafer holder and preferably discharge the fluid into the gap 26 in a downward direction, as shown. Here too, a fluid supply tube is connected to the inlet opening of the conduit. As can be seen in the Figure, the conduits 28 can be in the form of a manifold wherein a single main conduit portion 34 is connected to a plurality of radially extending conduits 28 such that the fluid flow in the gap 26 is more evenly distributed. A similar type of distribution can be provided to conduits going through the ring 24. A flexible gap seal membrane can also be provided in this and other embodiments.

Figure 5:
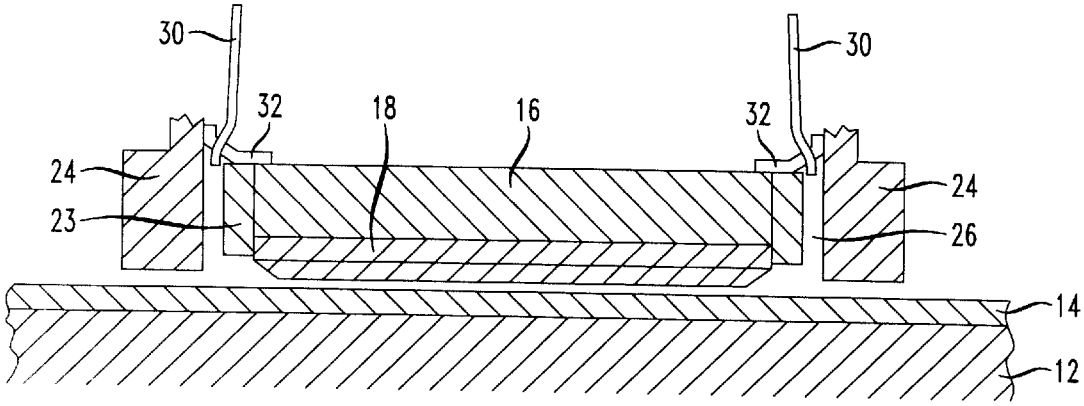
FIG. 5 is a side view of yet another embodiment of the invention wherein a the slurry is injected into the top of the gap between the retaining ring and the wafer holder.

Still another possible embodiment is shown in FIG. 5 wherein the fluid is delivered into the gap 26 by injecting it directly into the top of the gap 26 via one or more fluid supply tubes 30 which have their ends terminating in or immediately above the gap 26 so that the fluid flows directly into the gap from the supply tube. Here, when a gap seal membrane is provided, the fluid supply tube penetrates through the membrane.

It should be appreciated that the engineering details regarding manufacture of a device in accordance with the invention can be done by one with ordinary skill in the art and that the invention is not limited to the specific embodiments described herein.

What we claim is:

1. A method of chemically mechanically polishing a substrate utilizing an apparatus which includes a substrate holder and a retaining ring spaced from and around the periphery of the holder such that there is a gap between the holder and the ring, and a polishing pad on a platen comprising the step of supplying a fluid under pressure into said gap, said pressure maintaining a flatness of said pad during polishing of said substrate.

2. The method recited in claim 1 wherein supplying a fluid under pressure includes supplying a chemical mechanical polishing slurry under pressure.

3. The method recited in claim 1 wherein supplying a fluid under pressure includes supplying a fluid under pressure to create a pressure on the pad in the range of from about 1 psi to about 10 psi.

4. The method recited in claim 1 wherein supplying a fluid includes supplying a fluid into the gap via one or more conduits through the retaining ring.

5. The method recited in claim 1 wherein supplying a fluid includes supplying a fluid into the gap via one or more conduits in through the substrate holder.

6. The method recited in claim 1 wherein supplying a fluid includes supplying a fluid into the gap via one or more fluid supply tubes, the ends of which terminate in or immediately above the gap.

7. A chemical mechanical polishing apparatus comprising a rotatable platen, a polishing pad on said platen, a chemical mechanical polishing slurry delivery tube positioned so as to deliver slurry onto the polishing pad, a substrate holder for mounting a substrate to be polished thereon and a retaining ring spaced from and peripherally around the substrate holder, the apparatus further including a fluid delivery conduit configured to deliver a fluid, under pressure, into the space between the holder and the ring, said pressure maintaining a flatness of said pad during polishing of said substrate.

8. The chemical mechanical polishing apparatus recited in claim 7 wherein the fluid is a chemical mechanical polishing slurry.

9. The chemical mechanical polishing apparatus recited in claim 7 including a flexible gap seal.

10. The chemical mechanical polishing apparatus recited in claim 7 wherein said delivery conduit includes one or more conduits through the retaining ring.

11. The chemical mechanical polishing apparatus recited in claim 7 wherein said delivery conduit includes one or more conduits through the holder.

12. The chemical mechanical polishing apparatus recited in claim 7 wherein said delivery conduit includes one or more slurry delivery tubes extending into the top of the gap.

* * * * *